United States Patent [19]

Waeldner et al.

[11] 4,040,564

[45] Aug. 9, 1977

[54] SYSTEM POWERED DAMPER AND CONTROL UNIT

[75] Inventors: William J. Waeldner, Waverly; William J. Harris, Tunkhannock, both of Pa.

[73] Assignee: Dynamics Corporation of America, New York, N.Y.

[21] Appl. No.: 661,323

[22] Filed: Feb. 25, 1976

[51] Int. Cl.[2] ..... F24F 13/10

[52] U.S. Cl. ..... 236/49; 251/60; 251/86; 137/489; 236/80 R

[58] Field of Search ..... 236/49, 80 R; 251/61.1, 251/58, 285, 60, 86; 137/468, 498, 527.4

[56] References Cited

U.S. PATENT DOCUMENTS

| | | | |
|---|---|---|---|
| 430,301 | 6/1890 | Schenck | 251/86 |
| 2,998,194 | 8/1961 | Curran et al. | 137/489 |
| 3,159,376 | 12/1964 | Ray | 251/86 |
| 3,414,232 | 12/1968 | Hellman | 251/86 |
| 3,687,364 | 8/1972 | McNabney | 236/49 |
| 3,806,027 | 4/1974 | Ginn et al. | 236/49 |
| 3,809,314 | 5/1974 | Engelke et al. | 236/49 |
| 3,876,138 | 4/1975 | Dean, Jr. | 236/49 |
| 3,945,565 | 3/1976 | Lynch et al | 251/61 |

FOREIGN PATENT DOCUMENTS

| | | | |
|---|---|---|---|
| 1,387,005 | 3/1975 | United Kingdom | 236/49 |

*Primary Examiner*—John J. Camby
*Assistant Examiner*—Henry C. Yuen
*Attorney, Agent, or Firm*—McCormick, Paulding & Huber

[57] ABSTRACT

A damper and control unit for controlling air flow through a conduit comprises a movable damper having a ball-joint connection with the end of an actuating rod. The actuating rod has first and second angularly related portions and the first portion serves as a pivot element for a movable actuating plate, the second portion mounting the damper. The movable or swingable plate is arranged above an expandible and contractable actuating bellows and has a stop chain associated therewith for limiting downward swinging movement thereof in the direction of bellows contraction. The bellows has a supply line leading to the conduit upstream of the damper and a control unit is interposed in the line for determining bellows pressure. Conduit pressure and/or temperature signals are supplied to the control for bellows and damper operation as a function thereof. A seat associated with the damper is uniformly and tightly engaged whereby to seal the conduit due to the floating or ball-joint damper connection with its actuator. Bellows and actuating plate arrangement externally of the conduit results in a requirement for lesser bellows operating pressures and bellows isolation from fire code regulations.

16 Claims, 4 Drawing Figures

SYSTEM POWERED DAMPER AND CONTROL UNIT

BACKGROUND OF THE INVENTION

System powered damper and control units of the general type under consideration have heretofore been available as illustrated in U.S. Pat. No. 3,877,452, June 18, 1974, entitled DUCT PRESSURE ACTUATED VARIABLE VOLUME DEVICE. While such units have been generally satisfactory in operation, certain disadvantages have been encountered. Actuating bellows, disposed within an air conduit, housing, etc., and exposed externally to conduit air require an increment of operating pressure to overcome the externally acting air pressure and, in addition, such bellows must meet fire code regulations as regards contribution to smoke, fuel, etc. Further, a uniform and tight closing operation of the damper has not alwasy been provided for with the result that cooling or heating air is unnecessarily lost to the detriment of energy conservation considerations.

SUMMARY OF THE INVENTION

It is the general object of the present invention to provide an improved system powered damper and control unit wherein provision is made for the remote or external location of an actuating bellows, a consequent reduction in operating pressure requirements is achieved along with isolation from conduit air and the elimination of smoke, fuel contribution limitations, and wherein a free floating damper arrangement is provided resulting in the uniform and tight closing operation of the damper and in the optimization of energy conservation.

DESCRIPTION OF THE PREFERRED EMBODIMENT

Figure 1:
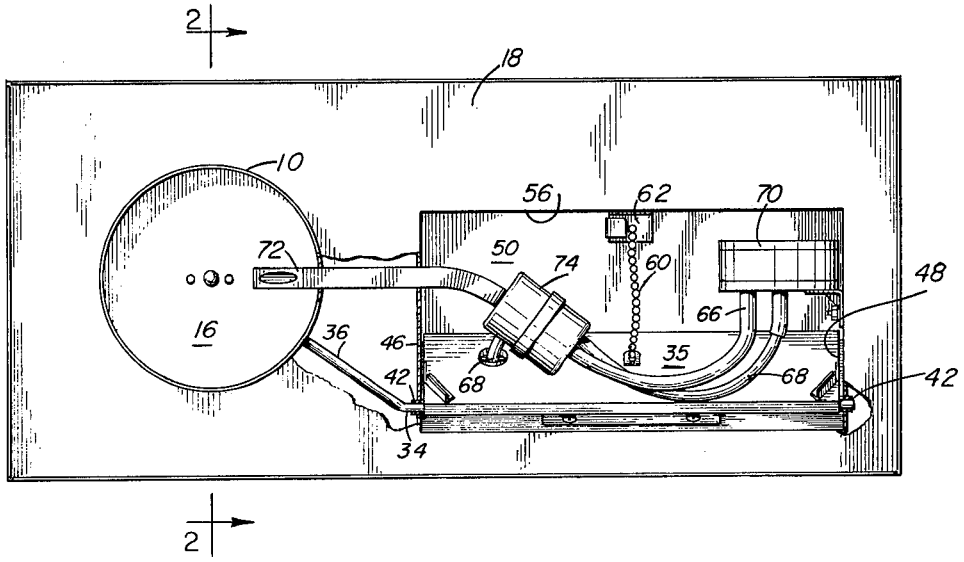
FIG. 1 is a front view of a damper and control unit with a portion of an associated housing broken away for clarity of illustration.
Figure 2:
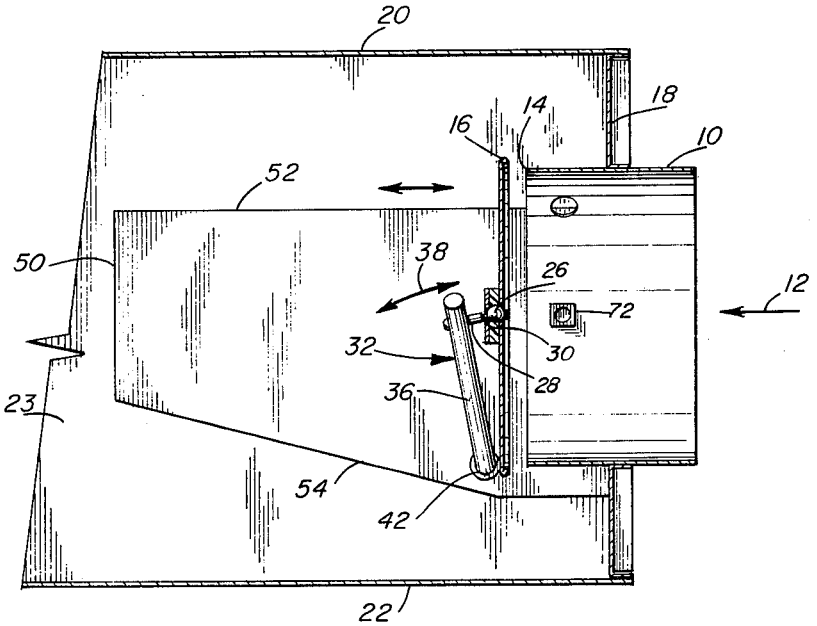
FIG. 2 is a sectional view taken generally as indicated at 2—2 in FIG. 1 and illustrating the damper and an associated control and actuator housing.
Figure 4:
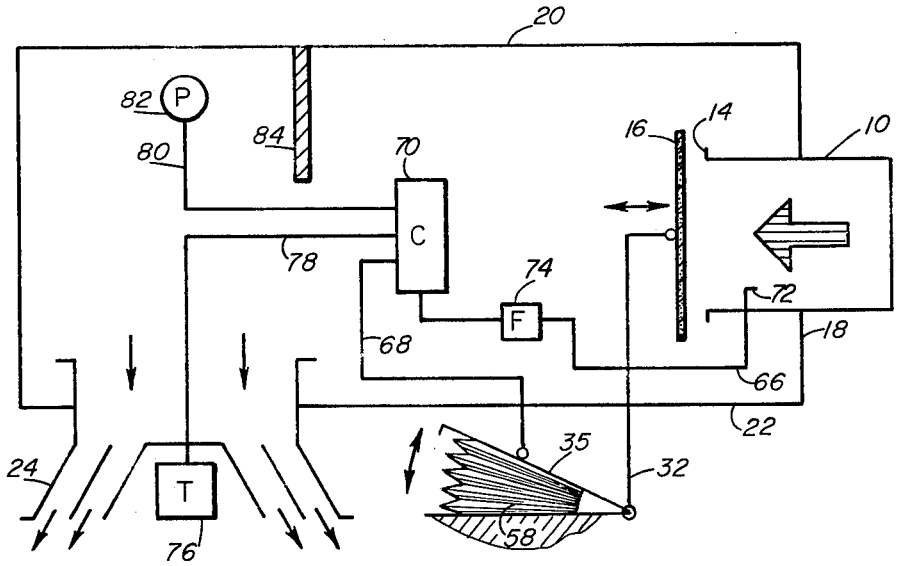
FIG. 4 is a schematic illustration of the improved damper and control unit of the present invention.

Referring particularly to FIGS. 1 and 2, it will be observed that a short cylindrical conduit section 10 receives a flow of heated, cooled, or otherwise conditioned air from right to left as indicated by the arrow 12. A left hand end portion of the conduit or conduit section 14 may be regarded as a seat 14 for a circular plate-like damper 16. The damper 16 is disposed within a housing or second conduit section which has a face plate 18 and top and bottom plates 20, 22, and side plates 23, 23, one shown in FIG. 2. The plates or housing members 18, 20, 22, 23 may form a part of a self-contained unit as illustrated schematically in FIG. 4 which receives conditioned air from the conduit 10 and which discharges the same through a diffuser shown schematically at 24. Alternatively, it will be obvious that the damper and control unit of the present invention may be employed in a straight length of conduit with a suitable seat, within various other housing and/or conduit arrangements, etc.

The damper 16 is movable between open and closed and intermediate positions for controlling conduit air flow and, in accordance with the present invention, the said damper is provided with a floating connection on an associated actuating means. Thus, when in its closed position and in engagement with the conduit section end surface or seat 14 in FIG. 2, the damper is in uniform and tight engagement and seals the conduit against accidental or unintended air flow. The leakage of heated, cooled, or otherwise conditioned air is thus positively prevented and a substantial improvement in energy conservation is achieved.

The manner in which a floating connection of the damper 16 is provided may vary within the scope of the invention but it is the presently preferred practice to employ a ball-joint connection as shown. That is, a small ball 26 is mounted or integrally formed on a short link 28 and is received within a partispherical opening in a member 30. The link 28 has its opposite end secured to an end portion of an actuating element 32 and the member 30 is mounted on a rear portion of the damper 16. Thus, slight universal movement of the damper is provided for as may be required for the uniform and tight engagement of the damper with its seat 14.

The actuating element 32, in the presently preferred form, comprises a rod having first and second portions 34, 36. The first portion 34 of the rod serves as a pivot element for an actuating plate 35 to be more fully described hereinbelow, and is disposed along a horizontal axis. The second portion 36 of the actuating rod is angularly misaligned or inclined with respect to the said first portion so that partial rotation of the first portion results in movement of the remote or free end of the second portion through an arc, as indicated generally by the arrow 38 in FIG. 2. The arcuate movement of the remote or free end of the second portion 36 of the actuating rod in turn moves the damper 16 in one and an opposite direction or toward and away from the seat 14. Leftward movement of the damper 16 in FIG. 2 of course enlarges the opening between the damper and the seat 14 whereby to increase conduit air flow and movement in a right hand direction tends to close the conduit to air flow.

Figure 3:
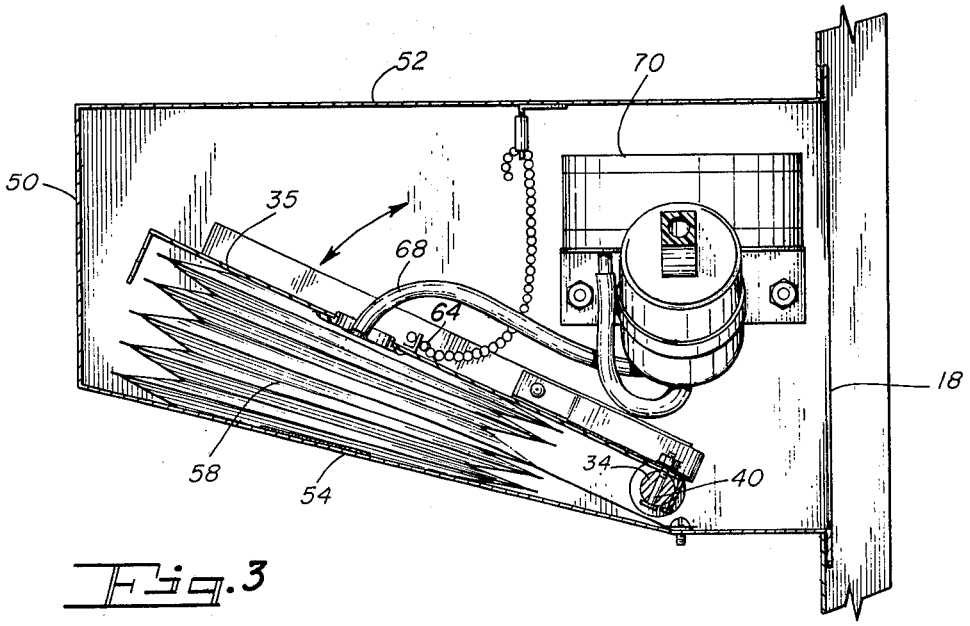
FIG. 3 is an enlarged view of the interior of the control and actuator housing illustrating the elements therein.

The actuating plate 35 is movable in one and an opposite direction to in turn move the actuating element or rod 32 and to move the damper 16 in its said one and opposite direction. Preferably and as illustrated, the actuating plate 35 is mounted for pivotal movement by connection with the aforementioned first portion 34 of the actuating element 32. As best illustrated in FIG. 3, a plurality of small bolts and nuts 40, 40 (one shown) are provided for connecting a lower edge portion of the plate 35 to the portion 34 of the actuating rod. Small bearing or journal members 42, 42 carry projecting opposite end portions of the rod portion 34 and are in turn supported in the side walls 46, 48 of a control and actuator housing. Thus, the pivot rod portion 34 can be partially rotated in one and an opposite direction by pivotal or swinging movement of the plate 35, the aforementioned arcuate movement of the second portion of the rod and the resulting damper movement being effected under the control of such partial rotation.

A rear wall 50 of the control and actuator housing is illustrated in FIGS. 1 and 2 and top and bottom walls 52, 54 provide for isolation of the interior of the housing from conduit air flow within the housing or conduit portion 18, 20, 22, 23. A front plate of the control and actuator housing, not shown, but readily attached over the opening 56 illustrated in FIG. 1 serves to isolate the interior of the housing from air under pressure forwardly or upstream thereof, that is, on the right hand side of the aforementioned plate 18 in FIG. 2. Thus, the elements within the control and actuator housing are isolated from the flow of conduit air thereover or may be said to be positioned remotely or externally of the conduit.

Disposed beneath and in engagement with the actuating plate 35, is an expansible and contractable bellows 58, best illustrated in FIG. 3. The bellows 58 may vary widely in construction, polypropylene being presently preferred. A fixed or reference member for the bellows takes the form of the bottom housing plate 54 and the actuating plate 35 is movable in response to bellows expansion and contraction in one and an opposite direction as aforesaid. As illustrated in FIG. 3, the plate 35 is movable in a clockwise direction about the portion 34 of the pivot rod on expansion of the bellows 58 and when the bellows is contracted, the plate 35 is allowed to swing in a counter-clockwise direction at the urging of gravity, the rod portion 34 being arranged with its axis horizontal as aforesaid.

Referring simultaneously to FIGS. 2 and 3, it will be apparent that expansion of the bellows 58 will result in clockwise movement of the actuating plate 35, partial rotation of the rod portion 34 in a clockwise direction, arcuate movement of the remote end of the rod portion 36 in a generally clockwise direction in FIG. 2 and in a closing movement of the damper 16 relative to the seat 14. Conversely, bellows contraction and the aforementioned gravity bias will result in counter-clockwise movement of the actuating plate 35, partial rotation of the rod portion 34 in a counter-clockwise direction, arcuate movement of the remote end of the rod portion 36 in a counter-clockwise direction and in opening movement of the damper 16 relative to its seat.

Preferably, a means is provided for limiting the movement of the damper 16 whereby to establish a predetermined minimum conduit pressure drop thereover, such pressure drop being held for the minimum conduit air flow to be anticipated. Thus the operation of the bellows, which is dependent upon conduit pressure is facilitated. Such limiting means may vary in form but preferably comprises a flexible element or small chain 60, FIG. 1, which has its upper end fixed by a small bracket 62 and which has a connection at a lower end 64 with the plate 35. A cut and try method may be employed to determine chain length and thus to determine the maximum open position of the damper 16 relative to its seat 14 whereby to establish a desired predetermined minimum pressure drop for the lowest upstream pressure and flow conditions to be encountered.

The manner in which bellows expansion and contraction is regulated may vary widely within the scope of the invention. The damper and control unit is, however, system powered in accordance with the invention and a small supply conduit communicates with the main conduit upstream of the damper for a supply of air under pressure. More specifically, a small supply conduit in FIG. 4 has first and second portions 66, 68 and a control unit 70 is interposed in the conduit between its said portions. The first portion 66 of the conduit projects into the aforementioned air conduit 10 and is preferably adapted for total pressure pickup as indicated at 72. A filter 74 also in the conduit portion 66 passes clean control air to the control unit 70 which in turn determines the pressure of the air in the second conduit portion 68 and thus within the bellows 58. The bellows position is thus determined under the control of the unit 70 and the gravity bias of the actuating plate 30 urging the bellows toward its contracted position.

The control unit 70 may vary widely in form and may be of the general type disclosed in the aforementioned U.S. Pat. No. 3,817,452 or of the type disclosed in U.S. Pat. No. 3,806,027 to Ginn et al., entitled MULTI PORT FLOW CONTROLLER. Control of the bellows and damper position may be a function of temperature and/or pressure and, as illustrated, a thermostat 76 may be provided at the diffuser 24 and connected with the control by means of a small conduit 78. Preferably the thermostat is of the bleed type so as to establish a pressure within the controller in accordance with the sensed temperature and thereby to determine bellows and damper position. Alternatively, a remote thermostat may be employed within a room or other enclosure to be conditioned by air discharged at the diffuser 24.

A pressure signal may also be employed in the control 70 as from a control conduit 80 and a pressure pickup at 82, located downstream of a partition 84 in the housing or conduit portion 18, 20, 22, 23, etc. Various other control signals may of course also be supplied to the control unit 70 in accordance with the invention.

As will be apparent from the foregoing, the remote or external location of the actuating bellows of the present invention avoids the problem of meeting fire code requirements as related to the flow of conditioned air over the bellows and whether the bellows may be a fuel or smoke contributor is rendered irrelevant. Further, the remote or external location of the bellows and its associated actuating plate renders the elements immune to the effect of pressurized conduit air and, in consequence, the bellows can operate at somewhat lower pressures than heretofore possible.

Still further, energy conservation is substantially enhanced over the prior art damper and control units with the floating connection of the damper and its actuating element and the resulting uniform and tight sealing engagement of the damper and its seat.

We claim:

1. In a system powered damper and control unit for controlling air flow through a conduit in an air conditioning system; the combination comprising a damper movable between open and closed positions for controlling conduit air flow, means defining a seat engageable by the damper in its closed position to seal the conduit against air flow, an expansible and contractible bellows disposed externally of said conduit, a fixed plate disposed on one side of said bellows, a movable plate disposed on an opposite side of said bellows and pivotally mounted on a generally horizontal axis for swinging movement in one and an opposite direction on expansion and contraction of the bellows, the weight of the plate bearing against and tending to contract the bellows for a gravity bias in said opposite direction and for damper opening movement, damper closing movement being effected by bellows expansion, pressure supply means interconnecting said bellows and conduit for a supply of air under pressure to the former, a control associated with said pressure supply means and bellows and operable to control bellows expansion and contraction and thereby determine the position of said movable plate, a motion transmitting device interconnecting said movable plate and damper and operable to position the latter in said conduit in accordance with plate position, said last mentioned means including a floating connection with said damper for accommodating free damper movement about at least two discrete axes and thereby permitting slight damper adjustment for full closing thereof against said seat and sealing of the conduit, and a means for limiting plate movement in the bellows contracting direction while permitting free bellows and plate movement in the bellows expanding direction, said means thus serving to limit damper movement in the conduit opening direction whereby to maintain a predetermined minimum conduit pressure drop for bellows operation under low flow conditions.

2. The combination in a system powered damper and control unit as set forth in claim 1 wherein said limiting means takes the form of a flexible member having one end fixed and an opposite end attached to said movable plate and limiting downward swinging movement thereof at the urging of gravity.

3. The combination in a system powered damper and control unit as set forth in claim 1 wherein said motion transmitting device takes the form of an elongated pivot element having a first portion mounted for rotation about a generally horizontal axis and fixed to said movable plate for partial rotation in unison with the swinging movement of the plate, said element having a second portion which is angularly displaced from said axis of said first portion so as to move arcuately at its remote end on said partial rotation of the first portion, and said damper being mounted at said remote end of said second portion so as to be moved arcuately in the aforesaid one and opposite directions.

4. The combination in a system powered damper and control unit as set forth in claim 1 wherein said means interconnecting said conduit and bellows includes a small supply conduit and said control, the latter serving to determine pressure in a portion of said conduit leading to the bellows and thus to control bellows expansion and contraction.

5. The combination in a system powered damper and control unit as set forth in claim 4 wherein at least one additional small conduit is provided between said conduit and said control for the supply of a conduit pressure signal to the latter.

6. The combination in a system powered damper and control unit as set forth in claim 4 wherein a thermostat is provided and is connected with said control for the temperature responsive operation of said damper.

7. The combination in a system powered damper and control unit as set forth in claim 5 wherein said supply conduit is provided with a total pressure pick up in the air conduit.

8. In a system powered damper and control unit for controlling air flow through a conduit in an air conditioning system; the combination comprising a damper movable between open and closed positions for controlling conduit air flow, means defining a seat engageable by the damper in its closed position to seal the conduit against air flow, an expansible and contractible bellows disposed externally of said conduit, a fixed plate disposed on one side of said bellows, a movable plate disposed on an opposite side of said bellows and pivotally mounted on a generally horizontal axis for swinging movement in one and an opposite direction on expansion and contraction of the bellows, the weight of the plate bearing against and tending to contract the bellows for a gravity bias in said opposite direction and for damper opening movement, pressure supply means interconnecting said bellows and conduit for a supply of air under pressure to the former, a control associated with said pressure supply means and bellows and operable to control bellows expansion and contraction and thereby determine the position of said movable plate, and a motion transmitting device interconnecting said movable plate and damper and operable to position the latter in said conduit in accordance with plate position, said last mentioned means including a floating connection with said damper for accommodating free damper movement about at least two discrete axes and thereby permitting slight damper adjustment for full closing thereof against said seat and sealing of the conduit, said motion transmitting device taking the form of an elongated pivot element having a first portion mounted for rotation about a generally horizontal axis and fixed to said movable plate for partial rotation in unison with the swinging movement of the plate, said element having a second portion which is angularly displaced from said axis of said first portion so as to move arcuately at its remote end of said partial rotation of the first portion, and said damper being mounted at said remote end of said second portion so as to be moved arcuately in the aforesaid one and opposite directions.

9. The combination in a system powered damper and control unit as set forth in claim 8 wherein said means interconnecting said conduit and bellows includes a small supply conduit and said control, the latter serving to determine pressure in a portion of said conduit leading to the bellows and thus to control bellows expansion and contraction.

10. The combination in a system powered damper and control unit as set forth in claim 9 wherein as least one additional small conduit is provided between said conduit and said control for the supply of a conduit pressure signal to the latter.

11. The combination in a system powered damper and control unit as set forth in claim 9 wherein a thermostat is provided and is connected with said control for the temperature responsive operation of said damper.

12. The combination in a system powered damper and control unit as set forth in claim 10 wherein said supply conduit is provided with a total pressure pick up in the air conduit.

13. The combination in a system powered damper and control unit as set forth in claim 8 and including means limiting movement of said bellows, plate and damper in the conduit opening direction whereby to maintain a predetermined minimum conduit pressure drop for bellows operation under low flow conditions.

14. The combination in a system powered damper and control unit as set forth in claim 8 wherein said movable plate is pivotably mounted on a generally horizontal axis for swinging movement in one and an opposite direction, the weight of the plate bearing against the bellows for a gravity bias.

15. The combination in a system powered damper and control unit as set forth in claim 14 wherein said bellows and damper are so arranged that bellows expansion moves the damper in the conduit closing direction and contraction thereof under the urging of the weight of the plate moves the damper in the conduit opening direction.

16. The combination in a system powered damper and control unit as set forth in claim 8 wherein said damper and said remote end of said second portion of said pivot element have a ball-joint connection for said floating movement of the damper.

* * * * *